US008540613B2

(12) United States Patent
Burford et al.

(10) Patent No.: US 8,540,613 B2
(45) Date of Patent: Sep. 24, 2013

(54) CENTRIFUGAL SEPARATOR WITH PROTECTED BEARING

(75) Inventors: Nigel Burford, Taunton (GB); Anthony W. Fell, Yeovil (GB); Klemens Dworatzek, Edingen (DE); Nicholas Foulkes, Chard (GB); John Lawrence Mills, Ilminster (GB)

(73) Assignee: Mann +Hummel GmbH, Ludwigsburg (DE)

( * ) Notice: Subject to any disclaimer, the term of this patent is extended or adjusted under 35 U.S.C. 154(b) by 0 days.

(21) Appl. No.: 13/609,812

(22) Filed: Sep. 11, 2012

(65) Prior Publication Data

US 2013/0005559 A1 Jan. 3, 2013

Related U.S. Application Data

(63) Continuation of application No. PCT/EP2011/052827, filed on Feb. 25, 2011.

(30) Foreign Application Priority Data

Mar. 11, 2010 (GB) ..... 1004032.7

(51) Int. Cl.
*B04B 9/06* (2006.01)

(52) U.S. Cl.
USPC ..... 494/36; 494/41; 494/49; 494/83

(58) Field of Classification Search
USPC ..... 494/24, 36, 43, 49, 56, 64, 65, 67, 494/83, 84, 901, 60, 74, 79; 210/168, 171, 210/232, 360.1, 380.1, 416.5; 184/6.24
See application file for complete search history.

(56) References Cited

U.S. PATENT DOCUMENTS

| | | | | | |
|---|---|---|---|---|---|
| 2,650,022 | A * | 8/1953 | Fulton et al. | ..... | 494/49 |
| 2,723,079 | A * | 11/1955 | More et al. | ..... | 494/15 |
| 3,273,324 | A * | 9/1966 | Jennings | ..... | 55/404 |
| 3,432,091 | A * | 3/1969 | Beazley | ..... | 494/36 |
| 3,879,294 | A * | 4/1975 | Ellis et al. | ..... | 210/354 |
| 4,011,972 | A * | 3/1977 | Pederson et al. | ..... | 494/41 |
| 6,019,717 | A * | 2/2000 | Herman | ..... | 494/49 |
| 6,294,091 | B1 * | 9/2001 | Hoff | ..... | 210/380.1 |
| 6,520,902 | B1 * | 2/2003 | Brown et al. | ..... | 494/24 |
| 6,530,872 | B2 * | 3/2003 | Frehland et al. | ..... | 494/49 |

(Continued)

FOREIGN PATENT DOCUMENTS

JP 49006254 B 2/1974

OTHER PUBLICATIONS

GB Search report on GB 1004032.7, Jul. 12, 2010.

*Primary Examiner* — Charles E Cooley
(74) *Attorney, Agent, or Firm* — Jim Hasselbeck

(57) ABSTRACT

To enable centrifugal filtration of fluids which contain abrasive contaminant particles the rotor bearings (3) must be isolated from the fluid which passes into and through the rotor chamber (21). This is achieved by a design in which the spindle (4) is connected to the rotor so as to rotate in unison with the rotor (5, 6, 7) relative to the base (1). The bearings (3) for the spindle (4) are provided in a bearing housing (2) which is fixedly mounted to the base (1) and a sealing arrangement, preferably a spring-loaded axial seal (14, 15), is provided between the spindle (4) and the base (1) at a location below the bearings (3) in the bearing housing (2).

8 Claims, 2 Drawing Sheets

(56) References Cited

U.S. PATENT DOCUMENTS 6,579,218 B1 * 6/2003 May et al. ..... 494/24
6,740,026 B2 * 5/2004 Samways ..... 494/12
2011/0011795 A1 * 1/2011 Hoff ..... 210/512.1
2013/0005559 A1 * 1/2013 Burford et al. ..... 494/41

* cited by examiner

CENTRIFUGAL SEPARATOR WITH PROTECTED BEARING

CROSS REFERENCE TO RELATED APPLICATIONS

This application is a bypass continuation of international application PCT/EP2011/052827 filed Feb. 25, 2011 designating the United States of America, and which is hereby incorporated by reference in its entirety. This application claims the benefit under 35 USC 119 of foreign application GB 1004032.7 filed in the United Kingdom on Mar. 11, 2010 and which is hereby incorporated by reference in its entirety.

TECHNICAL FIELD

The invention relates to a centrifugal separator, also known in the art as a "centrifugal filter".

BACKGROUND OF THE INVENTION

Centrifugal separators are well known for separating fluids of different densities or for separating particulate matter from liquids. The principle of operation of such a centrifugal separator is that a housing contains a rotor which is supported therein to spin at high speed about a substantially vertical axis. Fluid from which contaminants are to be removed is supplied to the rotor at elevated pressure along the axis of rotation. As this fluid passes through the rotor, denser contaminant materials or particles are separated therefrom centrifugally and retained in the rotor, typically as a cake adhering to the interior surface of the rotor, which is cleaned or replaced at intervals.

Self powered centrifugal separators in which the fluid from which contaminants are to be removed also provides the drive for the rotor have long been used in lubrication systems of vehicles, as well as in other industry of separation processes. GB 2160796 and GB 2296942 disclose self-powered centrifugal separators of the type which comprises a base, a substantially vertical spindle upstanding from the base, a rotor mounted on the spindle for rotation thereabout by reaction to fluid emission from rotor nozzles, the base having an inlet passage for said fluid and the spindle having an axial bore and outlets therefrom to supply fluid to the rotor from said inlet passage, and a cover mounted on the base and enclosing the rotor. In this type of separator the fluid is supplied at pressure from the base of the housing and flows upwards through the axial bore to outlets near the top of the bore, which is typically a blind bore. A releasable cap is typically mounted at the top of the spindle to secure the cover.

Hitherto it has not been possible to use a centrifugal separator, whether of the self powered type or when powered independently of the fluid being filtered, To clean, i.e. remove contaminant particles from, a liquid where the contaminant particles are abrasive, for example honing oil, grinding machine coolant, electrode discharge machining fluid, or oil quench fluid from furnaces. This is because the bearings upon which the rotor is mounted become very rapidly worn by the action of the abrasive particles and needed to be replaced too frequently. For example, after as little as 30 seconds operation with liquids containing abrasive particles the bearings may be worn sufficiently to prevent or at least adversely affect balanced rotation of the rotor and continued efficient centrifugal separation, and need to be replaced.

Also, it has not hitherto been possible to use such a separator (filter) to remove contaminant particles from a liquid which is not itself a lubricant as the liquid typically acts as lubricating fluid for the rotor bearings, as well as drive fluid for the rotor in the case of a self powered separator. Thus, it has not been feasible to use such a filter for water purification purposes, for example, for removal of particles from the water.

SUMMARY OF THE INVENTION

An object of the present invention is to design a centrifugal separator which can be used to clean a liquid which contains abrasive contaminant particles or a liquid which is not itself a lubricating fluid. More specifically the objective is to design such a separator where contact between the fluid to be separated and the bearings is eliminated. The bearing arrangement, allowing rotation of the rotor relative to fixed/stationary parts, must not be exposed to the liquid being cleaned, which in the case of a self powered separator is also the liquid driving the rotor.

In accordance with the present invention centrifugal separator is provided which comprises a base, a substantially vertical spindle upstanding from the base, a rotor mounted on the spindle and defining a rotor chamber surrounding the spindle, the base having an inlet passage for fluid to be filtered and the spindle having an axial bore and outlets therefrom to supply the fluid to be filtered to the rotor chamber from the inlet passage, and which is characterized in that the spindle is connected to the rotor so as to rotate in unison with the rotor relative to the base and bearings for the spindle are provided in a bearing housing which is fixedly mounted to the base, in that the spindle is also connected to the rotor in a manner which isolates the bearing housing from the rotor chamber, and in that a sealing arrangement is provided between the spindle and the base at a location below the bearings in the bearing housing.

It is important that the sealing arrangement is located below the bearings so that fluid circulating through the separator, which inevitably leaks through any sealing arrangement between rotating and stationary parts is prevented by gravity from entering the bearings. This can only satisfactorily be achieved in a design where the spindle is mounted to the rotor and rotates relative to the base and the bearing housing. This differs from conventional designs of self powered centrifugal separator where the spindle is stationary and the rotor rotates relative to the spindle.

It has been found that the sealing arrangement most suitably comprises an axial sealing arrangement as this presents a relatively small axial interface, reducing friction, in order to minimize drive losses on the rotor, and minimizing risk of clogging by contaminant particles compared to a radial interface seal.

The invention is equally applicable to a self powered separator, wherein the rotor is provided with nozzles and the rotor is caused to rotate by reaction to emission of the fluid which is being filtered from said nozzles, and to a centrifugal separator where the rotor is independently driven by means other than the fluid which is passed through the rotor, for example by means of a separate motor or turbine.

BRIEF DESCRIPTION OF THE DRAWINGS

The invention will be described further, by way of example, with reference to the accompanying drawings in which, in which.

Figure 1:
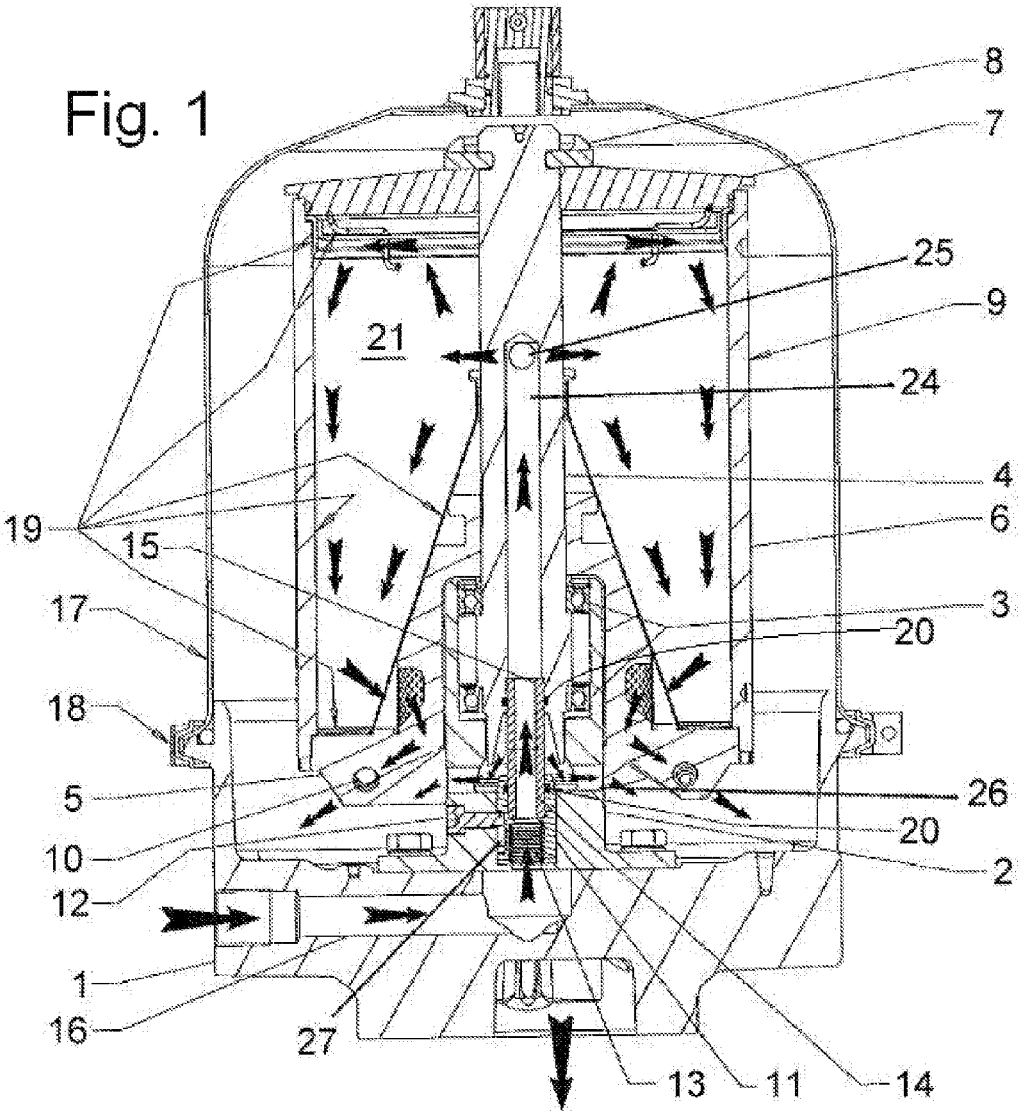
FIG. 1 depicts a longitudinal cross-section of a practical embodiment of a self powered centrifugal separator in accordance with the invention.
Figure 2:
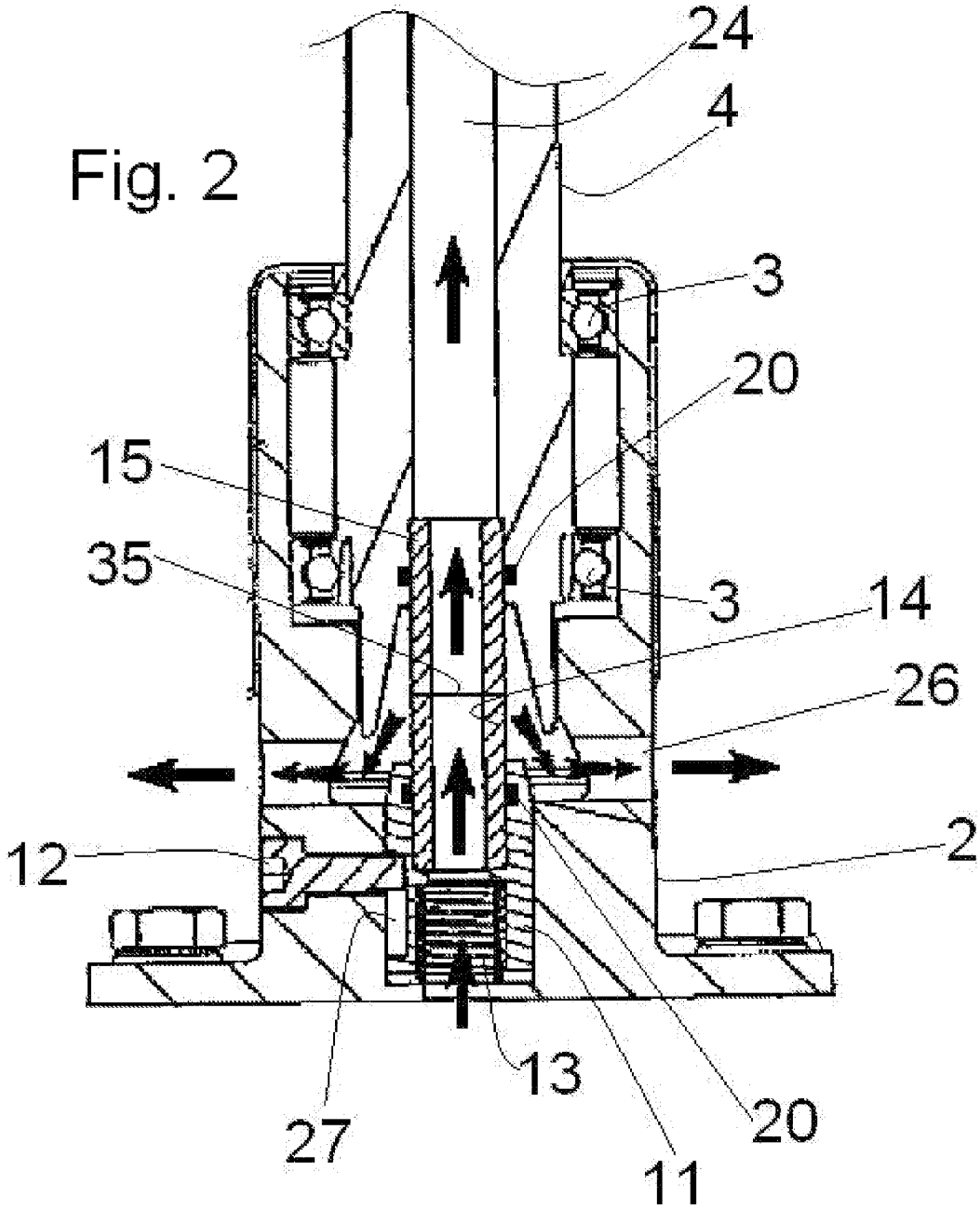
FIG. 2 depicts an enlargement of the bearing housing of FIG. 1, providing a larger view of components therein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

As shown, this exemplary embodiment of a self-powered centrifugal separator comprises a base 1, on which is rigidly fixed a bearing housing 2 which locates two rolling element bearings 3. The bearings 3 support, locate and allow rotation of a rotor assembly 9 comprising a spindle 4 onto which a rotor base 5, a rotor tube 6, a rotor cover 7 and a locking ring 8 are mounted, these parts defining a rotor chamber 21 and being fixed together for rotation in unison relative to the bearing housing 2. The bearings 3 are of standard greased type where the grease lubricant is held in by low friction seals and is intended to last the life of the bearings so that other lubrication is not necessary.

A pair of tangentially opposed nozzles 10 is fixed into the rotor base 5.

A removable basket assembly 19 fits inside the chamber 21 defined by the rotor assembly 9 and serves to aid removal of the rotor contents on cleaning. The main basket part of the assembly 19 is formed of mesh.

A cover assembly 17 is mounted over the rotor assembly 9 and is secured to the base 1 by means of a clamp 18.

The spindle 4 has a central bore 24 extending through from its lower end to join with a drilling 25 situated within the enclosure of the rotor assembly 9 at right angles to the central bore 24 of the spindle 4.

A seal sleeve 11 is fitted into the bearing housing 2 and is free to slide in the vertical sense. The seal sleeve 11 is prevented from rotating by a screw 12 which extends through the housing 2 and engages into a vertical slot 27 in the seal sleeve 11. Such engagement of the screw 12 into the seal sleeve 11 also serves to prevent the seal sleeve 11 from departing from the bearing housing 2 in the vertical sense. In this respect the seal sleeve 11 is urged in an upward direction by the compressed force of a spring 13 which sits in the bottom of the seal sleeve 11 and acts between it and the housing 2.

An axial sealing arrangement 14,15 is provided between the spindle 4 and the bearing housing 2. This axial seal 14,15 comprises a tubular lower seal component 14 which is fitted coaxially into the seal sleeve 11 and a tubular upper seal component 15 which is fixed coaxially into the lower end of the spindle 4. The seal interface 35 between these seal components 14, 15 is below the level of both the bearings 3 in the housing 2. The force acting on the seal sleeve 11 by virtue of the spring 13 is transmitted to the upper face of the lower seal component 14 which bears against the lower face of the upper seal component 15. In operation of the centrifuge, the upper seal component 15 is, of course, rotating because it is fixed into the lower end of the rotating spindle 4, while the lower seal component 14 remains stationary as it is fixed against rotation in the sleeve 11, which is also, as already explained, mounted to be non-rotatable in the housing 2.

A fluid passageway extends through the base 1 from an inlet port 16 to supply fluid to the bore of the lower seal component 14 via the axial passages of the spring 13 and the seal sleeve 11. The fluid passage extends via the axial bore of the rotating seal component 15, the axial bore 24 and cross drilling 25 of the spindle 4, to enter the enclosed space which is the rotor chamber 21 of the rotor assembly 9.

The force of the spring 13 prevents the majority of supplied fluid from the inlet port 16 from escaping from the interface between the lower seal component 14 and the rotating seal component 15. That fluid which may escape from the interface between the lower seal component 14 and the rotating seal component 15 can drain to the base 1 via drillings 26 in the bearing housing 2. Moreover, components mounting the sealing arrangement 14, 15, such as the lower end of the spindle 4 and the seal sleeve 11 in the illustrated example, or any other intermediate mount in other embodiments, are configured to direct fluid leaking from the interface downwards towards the drainage openings (drilling is 26) in the housing 2 from where it passes into the base 1 of the centrifuge.

The lower seal component 14 and the rotating seal component 15 need to be made from suitably durable material to adequately resist abrasion from the particulate matter contained within the supplied fluid. In particular, the seal interface must be sufficiently wear resistant to maintain long operating periods between repair or changing of the seal components and it must provide low friction to minimize drive losses on the rotor. Ceramic material has been found suitable for the cylindrical seal components 14, 15, but other material or material combinations may also prove suitable.

The pressure of the fluid and its tangential emission via the nozzles 10 drives the rotor assembly 9 and by centrifugal force separates particulate matter which adheres to the interior surface of the removable basket assembly 19. The fluid from which particulates have been separated drains from the base 1 to a sump (not shown) and may be re-circulated to the inlet port 16.

At intervals it is necessary to remove the rotor basket assembly 19 and the contaminant collected therein for cleaning out or replacement. The clamp 18, the filter cover assembly 17, the locking ring 8 and the rotor cover 7 must be removed before the removable rotor basket assembly 19 can be removed for cleaning. The clamp 18 allows for quick release of the cover assembly 17 before the locking ring 8 and rotor cover 7 are removed.

The lower seal component 14 and the rotating seal component 15 are retained in the axial and rotational sense by friction due to compression of respective O-rings 20. Upon disassembly of the arrangement shown, the lower seal component 14 and rotating seal component 15 can be replaced when excessively worn.

Throughout the description and claims of this specification, the words "comprise" and "contain" and variations of them mean "including but not limited to", and they are not intended to (and do not) exclude other components. Throughout the description and claims of this specification, the singular encompasses the plural unless the context otherwise requires. In particular, where the indefinite article is used, the specification is to be understood as contemplating plurality as well as singularity, unless the context requires otherwise.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A centrifugal separator comprising:

a base;

a substantially vertical spindle upstanding from the base;

a rotor mounted on the spindle and defining a rotor chamber surrounding the spindle;

wherein the base includes an inlet passage receiving fluid to be filtered; and wherein the spindle includes an axial bore and outlets therefrom to supply the fluid to be filtered to the rotor chamber from the inlet passage;

wherein the spindle is connected to the rotor so as to rotate in unison with the rotor relative to the base and wherein bearings for rotation of the spindle relative to the base are provided in a bearing housing which is fixedly mounted to the base, in that the spindle is also connected to the rotor in a manner which isolates the bearing housing from the rotor chamber; and an axial sealing arrangement comprising:

an elongated stationary non-rotating tubular seal component mounted to the base, the seal component having a first axial bore extending therethrough and through opposing axial end faces of the non-rotating tubular seal component;

an axially elongated rotating tubular seal component mounted to the spindle and rotating with the spindle, the rotating seal component having a second axial bore extending therethrough and through opposing axial end faces of the rotating tubular seal component;

wherein a first one of the end faces of the rotating tubular seal component contacts and rotates upon a second one the end faces of the non-rotating tubular seal component forming a seal interface, the seal interface forming a rotary seal connecting the first and second axial bores such that a major portion of fluid flow in the first and second axial bores is prevented from escaping through the seal interface;

wherein the sealing arrangement is provided, separate from the rotation bearings, between the spindle and the base at a location below the bearings in the bearing housing.

2. The centrifugal separator according to claim 1, wherein the axial sealing arrangement is spring loaded.

3. The centrifugal separator according to claim 2, wherein the first and second end faces of the tubular seal components are urged into end-to-end axial sealing contact by the spring loading.

4. The centrifugal separator according to claim 1, further comprising a removable basket assembly mounted in the rotor chamber.

5. The centrifugal separator according to claim 1, further comprising a cover assembly which is mounted over the rotor and secured to the base by a quick release clamp.

6. A self powered centrifugal separator according to claim 1, wherein the rotor is provided with nozzles and the rotor is caused to rotate by reaction to fluid emission from said nozzles.

7. The centrifugal separator according to claim 1, further comprising a bearing housing aperture arranged below the spindle bearings and extending from an interior to an exterior of the bearing housing, the aperture positioned to drain fluid leakage of the seal interface away from the spindle bearings and instead to the exterior of the bearing housing.

8. The centrifugal separator according to claim 1, wherein the mounting of the non-rotating tubular seal component to the base is by radial friction compression of a first O-ring arranged therebetween, the non-rotating tubular seal component removable from the base for replacement by overcoming the O-ring frictional mounting;

wherein the mounting of the rotating tubular seal component received into and mounted to the spindle is by radial friction compression of a second O-ring arranged therebetween, the rotating tubular seal component removable from the spindle for replacement by overcoming the O-ring frictional mounting of the second O-ring for replacement.

* * * * *